US005269883A

United States Patent [19]

Beuther

[11] Patent Number: 5,269,883

[45] Date of Patent: Dec. 14, 1993

[54] METHOD FOR CONTROLLING BASIS WEIGHT IN THE PRODUCTION OF STRETCHABLE WEBS

[75] Inventor: Paul D. Beuther, Neenah, Wis.

[73] Assignee: Kimberly-Clark Corporation, Neenah, Wis.

[21] Appl. No.: 618,202

[22] Filed: Nov. 26, 1990

Related U.S. Application Data

[62] Division of Ser. No. 576,240, Aug. 31, 1990, Pat. No. 5,026,458.

[51] Int. Cl.[5] ..... D21F 11/00

[52] U.S. Cl. ..... 162/198; 162/111; 162/197; 162/DIG. 10; 162/DIG. 11

[58] Field of Search ..... 162/111, DIG. 10, DIG. 11, 162/198, 197, 259, 258; 364/471, 469; 356/28.0, 28.5

[56] References Cited

U.S. PATENT DOCUMENTS

| | | | |
|---|---|---|---|
| 3,586,601 | 6/1971 | Persik et al. | 162/198 |
| 3,803,420 | 4/1974 | Bossons | 250/562 |
| 4,247,204 | 1/1981 | Merlen et al. | 250/563 |
| 4,875,769 | 10/1989 | Linebarger | 356/28 |

FOREIGN PATENT DOCUMENTS

| | | | |
|---|---|---|---|
| 0015820 | 9/1980 | European Pat. Off. | 356/28 |
| 923873 | 4/1963 | United Kingdom | 162/DIG. 11 |

OTHER PUBLICATIONS

O'Connor, R. E. The Dictionary of Paper, Third Edition, George Banta Company, Inc. Menasha, Wis. 1965, pp. 146 ∝ 147.

*Primary Examiner*—W. Gary Jones
*Assistant Examiner*—Brenda Lamb
*Attorney, Agent, or Firm*—Gregory E. Croft

[57] ABSTRACT

In the manufacture of stretchable webs such as creped tissue, nonwovens, and the like, in which the web is formed and thereafter wound onto a reel, basis weight control of the web on the reel is accomplished by measuring the speed and basis weight of the web prior to winding the web onto the reel and calculating the basis weight of the web on the reel. In response to this calculated value, either the upstream flow of material or the downstream speed of the web (reel speed) are adjusted to obtain the desired basis weight of the web at the reel.

3 Claims, 2 Drawing Sheets

METHOD FOR CONTROLLING BASIS WEIGHT IN THE PRODUCTION OF STRETCHABLE WEBS

This is a divisional of copending application(s) Ser. No. 07/576,240 filed on Aug. 31, 1990, now U.S. Pat. No. 5,026,458.

BACKGROUND OF THE INVENTION

In the manufacture of stretchable webs, such as creped tissues or paper towels, the control of basis weight is important from the standpoint of quality control and process economics. In the tissue industry, the basis weight of a web is generally expressed in terms of grams per square meter. Typically, tissue basis weights may range from about 10 to about 35 g/m$^2$ and paper towels may range from about 20 to about 70 g/m$^2$. Current industrial practice in the tissue industry is to control basis weight by measuring the basis weight of the tissue web at a point between the Yankee dryer and the reel and adjusting the mass flow rate of the stock system as needed based on that measurement. In so doing, the speed of the web is generally assumed to be linearly related to the speed of the reel. The speed of the web is also assumed to be constant at the selected location of the basis weight sensor with respect to other possible variables. Since the web speeds at the Yankee and the reel are known and fixed by their respective drive systems, the basis weight of the web at the reel can be calculated by using the basis weight of the web measured between the Yankee and the reel and an estimated web speed.

The problem with this approach is that the speed of the web between the Yankee dryer and the reel is not constant and is not linearly related to the speed of the reel for stretchable webs such as tissue. This is shown in FIG. 1, which is a plot of the tissue web velocity between the Yankee and the reel. In fact, the web speed can vary due to many factors which are not taken into account by current control systems, such as moisture content, formation, crepe uniformity, furnish, etc. as is shown in FIG. 2. As a result, the control system may adjust the stock flow when adjustment is not needed. Therefore there is a need for an improved method of controlling the basis weight of stretchable webs.

SUMMARY OF THE INVENTION

In general, the invention resides in a method for controlling the basis weight of a stretchable web which is formed and thereafter wound onto a reel, wherein the basis weight of the web at the reel is controlled by measuring the speed and basis weight of the stretchable web prior to the reel and, in response to the calculated value, adjusting either the upstream flow of material during formation of the web to change the basis weight of the newly formed web or adjusting the downstream speed of the web (reel speed) to alter the extent to which the web is stretched and hence change the final basis weight.

In the case of making creped tissue, the invention resides in a method in which the tissue web is continuously formed by the flow of papermaking stock through a headbox onto a forming fabric, said web being thereafter dried, creped from a creping cylinder, and wound onto a reel, the improvement comprising: (a) measuring the basis weight and speed of the web at a point between the creping cylinder and the reel; (b) calculating the basis weight of the web at the reel in accordance with the formula: $BW_R = BW\ (V/V_R)$ wherein "$BW_R$" is the basis weight of the web at the reel, "BW" is the basis weight of the web as measured in step (a), "V" is the speed of the web as measured in step (a), and "$V_R$" is the speed of the web at the reel (as determined by the rotational speed of the reel and the diameter of the roll being wound onto the reel for a center-wound reel or by the rotational speed of the reel drum drive and its diameter for a surface wound reel); and (c) controlling the flow of papermaking stock to the headbox based on the calculated basis weight of the web at the reel determined in step (b). Although this invention is described in terms of controlling the manufacture of creped tissue webs, it is applicable to the manufacture of any stretchable web which is wound onto a reel.

An alternative control strategy within the scope of this invention that might be preferred for other stretchable webs such as nonwoven polymeric or glass webs would be to measure the basis weight of the web as described above and thereafter control the downstream reel speed instead of the upstream material flow rates in order to maintain constant basis weight by controlling stretch. Although this would work for tissue webs also, the preferred control means for tissue is to adjust the stock flow because changing the reel speed alters the final product properties, particularly the stretch.

In carrying out the control method of this invention, it is preferred that the means for measuring the speed of the web between the creping cylinder and the reel does not contact the web. This provides an advantage in that the web is not damaged or otherwise modified by the contact with a speed measurement device. A particularly suitable speed measuring means is SensorLine TM, an instrument made by Dantec Electronics (Mahwah, N.J.). The device uses a small semiconductor laser which emits two parallel laser beams. The light reflected from the two spots on the web surface is processed to determine the velocity of the web. The depth of field for measurement for this instrument is 20 millimeters. In this regard it is preferable that the measurement depth of field be about 20 millimeters or greater to accommodate web flutter (movement of the web perpendicular to the plane of the web) which is common in high speed manufacturing processes. However, other suitable devices, such as standard laser doppler velocimeters, can also be used to make this velocity measurement. These devices, such as one made by TSI Inc. (St. Paul, Minn.), work on a doppler shift principle and usually use two crossed laser beams. Because the point of measurement is at the crossing point of the laser beams, the depth of field on these devices is much smaller than the SensorLine TM device at equivalent accuracy, typically less than 4 millimeters. This relatively short depth of field makes sheet flutter a problem because the signal is lost when the web moves outside of this range.

The means for measuring the basis weight of the web can be any such device known in the art. These devices typically use a beta radiation source on one side of the sheet and a receiver such as an ion tube on the other to measure the attenuation of radiation. The basis weight is related to the radiation intensity by the Lambert-Bier Law. A suitable system would be a basis weight gauge made by Accuray.

The speed of the web at the reel is routinely monitored or measured by controlling the speed of the reel drive roll which maintains a constant web speed. Suitable reels which have this capability include Beloit Corporation single drum reels.

DETAILED DESCRIPTION OF THE DRAWING

Figure 1:
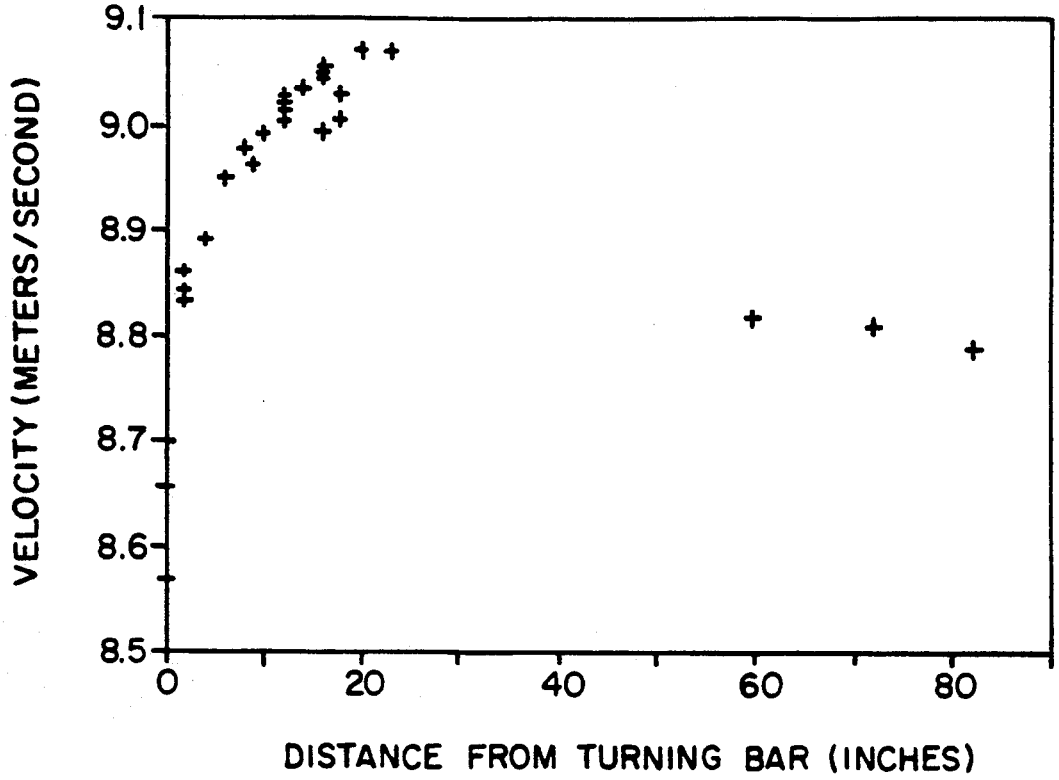
FIG. 1 is a plot of a tissue web velocity profile between the Yankee and the reel, illustrating the nonlinear relationship between the Yankee speed and the reel speed.
Figure 2:
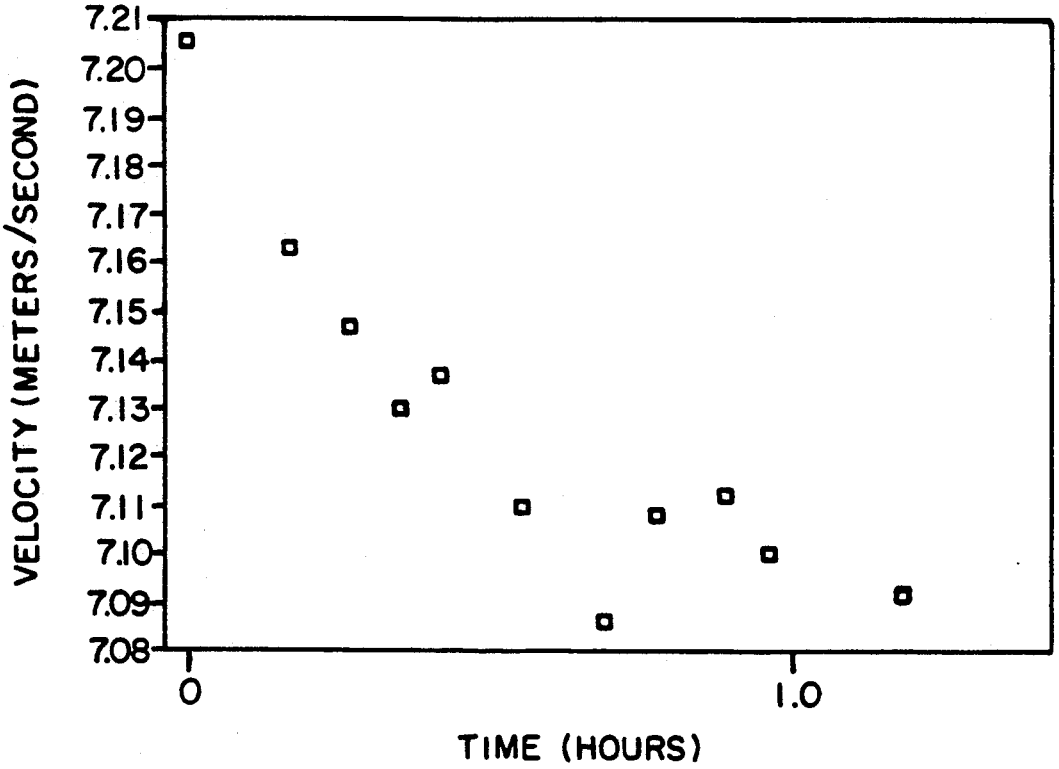
FIG. 2 is a plot of the variation of the tissue web velocity over time, showing clearly why an assumption of constant velocity results in a poor control strategy.

Referring to the drawing, the invention will be described in more detail. FIGS. 1 and 2 are as described above, illustrating the web velocity data taken from a creped tissue web produced as depicted in FIG. 3.

Figure 3:
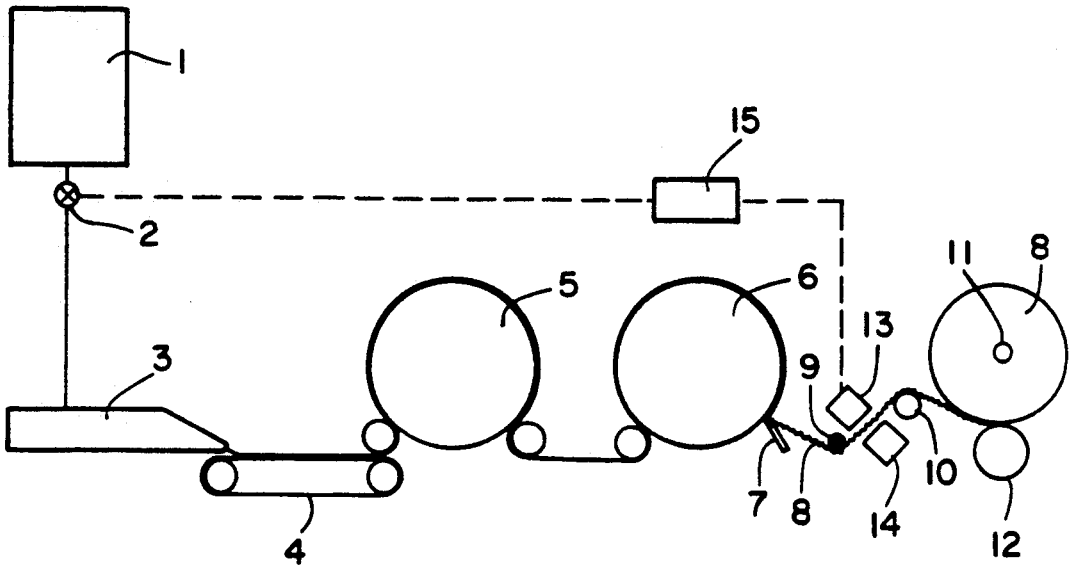
FIG. 3 is a schematic flow diagram of a tissue making process, illustrating the control loop utilized by the method of this invention.

FIG. 3 schematically illustrates a creped tissue making process and the manner in which the control method of this invention applies is applicable. Shown is the stock holding tank 1 from which the aqueous slurry of papermaking fibers (stock) is continuously metered through a metering valve 2 to the headbox 3. The headbox deposits the slurry onto a forming wire 4 which retains the fibers and allows the water to drain through. The wet web is then transferred to the surface of a rotating dryer 5 and dried. The web is then adhered to the surface of a creping cylinder 6, such as a Yankee dryer, and creped therefrom by dislodging the web via contact with a doctor blade 7. The resulting creped web 8 traverses a short free span and passes around turning bar 9 and spreader roll 10 (located about 50 inches from the spreader bar) before being wound into a softroll on a reel 11 (located about 90 inches from the spreader bar). The reel is preferably driven by a suitable drive roll 12. Also shown are upper portions 13 and lower portions 14 of the basis weight and web speed measuring devices (located about 30 inches from the spreader bar). These devices are preferably positioned side-by-side (see FIG. 4). The basis weight and speed measurements of the stretchable web at this intermediate point in the process are relayed to a computer 15 which calculates the web basis weight at the reel as previously described. The computer then signals the metering valve to increase or decrease the flow of stock to the headbox as determined by the preselected desired basis weight value at the reel.

Figure 4:
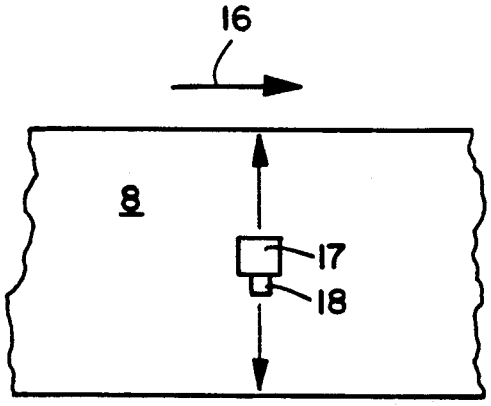
FIG. 4 is a plan view of the tissue web between the creping cylinder and the reel, illustrating the positions of the basis weight measuring device and the web speed measuring device.

FIG. 4 is a plan view of the creped web between the creping cylinder and the reel. Shown is the web 8 which travels in the direction of the arrow 16. The basis weight measuring device 17 and the speed measuring device 18 are preferably positioned side-by-side as shown in order to obtain measurements which represent the same point on the web as closely as possible. As shown, the pair of measuring devices traverse the web back and forth to obtain readings across the entire deckle of the web. However, it is also within the scope of this invention that the velocity sensor can be in a fixed position while the basis weight sensor traverses the web.

It will be appreciated that the foregoing description, given for purposes of illustration, is not to be construed as limiting the scope of the invention.

I claim:

1. In a method for making a creped tissue web in which the tissue web is continuously formed by the flow of papermaking stock through a headbox onto a forming fabric, said web being thereafter dried, creped from a creping cylinder, and wound onto a reel, the improvement comprising:

(a) measuring the basis weight and speed of the web at a point between the creping cylinder and the reel;

(b) calculating the basis weight of the web at the reel in accordance with the formula: $BW_R = BW(V/V_R)$ wherein "$BW_R$" is the basis weight of the web at the reel, "BW" is the basis weight as measured in step (a), "V" is the speed of the web as measured in step (a), and "$V_R$" is the speed of the web at the reel; and (c) controlling the flow of papermaking stock to the headbox based on the calculated basis weight of the web at the reel as determined in step (b).

2. The method of claim 1 wherein the means for measuring the speed of the web at a point between the creping cylinder and the reel does not contact the web.

3. The method of claim 2 wherein the means for measuring the speed of the web is a laser emitting device having a measurement depth of field of about 20 millimeters or greater.

* * * * *